US011851843B2

(12) United States Patent
Jung et al.

(10) Patent No.: US 11,851,843 B2
(45) Date of Patent: Dec. 26, 2023

(54) HYDRAULIC MACHINE

(71) Applicant: Volvo Construction Equipment AB, Eskilstuna (SE)

(72) Inventors: Taerang Jung, Gyeongsangnam-do (KR); Sangmin Gwon, Gyeongsangnam-do (KR); Sangki Bae, Gyeongsangnam-do (KR)

(73) Assignee: Volvo Construction Equipment AB, Eskilstuna (SE)

( * ) Notice: Subject to any disclaimer, the term of this patent is extended or adjusted under 35 U.S.C. 154(b) by 151 days.

(21) Appl. No.: 17/601,211

(22) PCT Filed: Apr. 5, 2019

(86) PCT No.: PCT/KR2019/004087
§ 371 (c)(1),
(2) Date: Oct. 4, 2021

(87) PCT Pub. No.: WO2020/204236
PCT Pub. Date: Oct. 8, 2020

(65) Prior Publication Data
US 2022/0162829 A1 May 26, 2022

(51) Int. Cl.
*E02F 3/43* (2006.01)
*E02F 9/22* (2006.01)

(52) U.S. Cl.
CPC ..... *E02F 3/435* (2013.01); *E02F 9/2203* (2013.01)

(58) Field of Classification Search
CPC . F15B 2211/761; F15B 11/024; E02F 9/2203; E02F 3/435
See application file for complete search history.

(56) References Cited

U.S. PATENT DOCUMENTS 6,092,454 A * 7/2000 Vande Kerckhove ..... F15B 13/042 91/464
8,807,013 B2 8/2014 Sohn
(Continued)

FOREIGN PATENT DOCUMENTS

CN 105339679 A 2/2016
CN 105705706 A 6/2016
(Continued)

OTHER PUBLICATIONS

Chinese First Office Action dated Sep. 28, 2022, for Chinese Patent Application No. 201980095034.4, 15 pages (including English translation).
(Continued)

*Primary Examiner* — Abiy Teka
(74) *Attorney, Agent, or Firm* — Sage Patent Group

(57) ABSTRACT

A hydraulic machine includes a tank; a working device including a boom; a boom cylinder which operates the boom and has a large chamber and a small chamber; a floating hydraulic circuit connected to the large chamber, the small chamber, and the tank so as to enable the large chamber, the small chamber, and the tank to communicate with each other; and an operator input device for receiving, from a driver, a request for turning on or turning off the floating hydraulic circuit. In the case of a boom down operation for lowering the boom, it is determined whether the working device floats in the air, and when it is determined that the working device floats in the air, the floating hydraulic circuit can be turned off, even if the request for turning on the floating hydraulic circuit is input to the operator input device.

8 Claims, 3 Drawing Sheets

(56) References Cited

U.S. PATENT DOCUMENTS

| | | | | |
|---|---|---|---|---|
| 10,094,092 | B2 | 10/2018 | Joung et al. | |
| 10,208,456 | B2 | 2/2019 | Ku | |
| 10,273,658 | B2 | 4/2019 | Hijikata et al. | |
| 10,407,876 | B2 | 9/2019 | Joo et al. | |
| 2003/0230082 | A1* | 12/2003 | Wook Kim | F15B 13/0403 60/429 |
| 2007/0033933 | A1 | 2/2007 | Bitter | |
| 2016/0222633 | A1* | 8/2016 | Kang | F15B 13/01 |
| 2016/0333551 | A1* | 11/2016 | Joung | E02F 9/2207 |

FOREIGN PATENT DOCUMENTS

| | | | |
|---|---|---|---|
| JP | 2009250361 | A | 10/2009 |
| KR | 20100056087 | A | 5/2010 |
| KR | 20170032417 | A | 3/2017 |
| KR | 20170139681 | A | 12/2017 |

OTHER PUBLICATIONS

International Search Report and Written Opinion of the International Searching Authority, PCT/KR2019/004087, dated Jan. 3, 2020, 9 pages (including English International Search Report).

* cited by examiner

HYDRAULIC MACHINE

CROSS REFERENCE TO RELATED APPLICATIONS

This application is a 35 U.S.C. § 371 national stage application of PCT International Application No. PCT/KR2019/004087 filed on Apr. 5, 2021, the disclosure and content of which is incorporated by reference herein in its entirety.

TECHNICAL FIELD

The present disclosure relates to a hydraulic machine configured to recover energy discharged from a boom actuator.

BACKGROUND

A hydraulic machine is an apparatus configured to carry out work by supplying high-pressure pressure fluid to (an actuator of) a working device. To increase the fuel efficiency of such a hydraulic machine, a technology of recovering energy contained in the fluid discharged from a boom actuator has been proposed.

Some hydraulic machines have a floating function. The floating function allows for moving the working device up and down along a curved ground surface using the weight thereof.

In a hydraulic machine of the related art, when an operator inputs a request to activate the floating function to an operator input device, the floating function is on, irrespective of the position of the working device. As a result, a large chamber and a small chamber of the boom actuator and a tank are in communication with each other, and thus, even in a boom down operation in which a bucket is hanging in the air, energy contained in the fluid discharged from the boom actuator cannot be recovered.

SUMMARY

Accordingly, the present disclosure has been made in consideration of the above-described problems occurring in the related art, and the present disclosure proposes a hydraulic machine configured to recover energy contained in the fluid discharged from a boom actuator, considering the position of a working device in a boom down operation, even in the case that a floating mode is selected by an operator, thereby obtaining superior fuel efficiency.

In order to achieve the above objectives, according to one aspect of the present disclosure, a hydraulic machine may include: a tank; a working device including a boom; a boom cylinder actuating the boom and including a large chamber and a small chamber; a floating hydraulic circuit connected to the large chamber, the small chamber, and the tank to perform a floating function enabling the large chamber, the small chamber, and the tank to communicate with each other; and an operator input device receiving a request to activate or deactivate the floating hydraulic circuit, input by an operator. In a boom-down operation in which the boom is lowered, the hydraulic machine may determine whether or not the working device is hanging in the air, and when the working device is determined to be hanging in the air, deactivate the floating hydraulic circuit even when the request to activate the floating hydraulic circuit is input to the operator input device.

In some embodiments, the hydraulic machine may further include a pressure sensor measuring a pressure in the large chamber and a pressure in the small chamber. The hydraulic machine may determine whether or not the working device is hanging in the air based on the pressure in the large chamber and the pressure in the small chamber.

When the pressure in the large chamber−the pressure in the small chamber/(an effective area on which the pressure in the large chamber acts/an effective area on which pressure of small chamber acts) is higher than a predetermined value, the working device may be determined to be hanging in the air When the pressure in the large chamber is higher than a predetermined value, the working device may be determined to be hanging in the air.

According to embodiments, the present disclosure may obtain the above-described objectives.

DETAILED DESCRIPTION OF EMBODIMENTS

Hereinafter, embodiments of the present disclosure will be described in detail with reference to the accompanying drawings.

Figure 1:
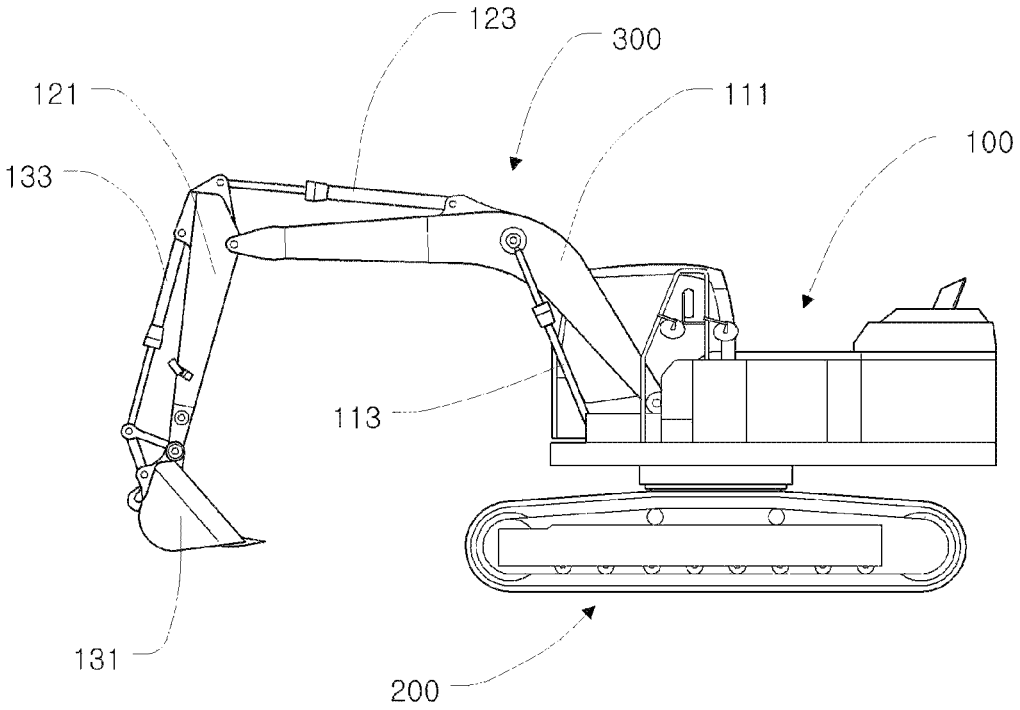
FIG. 1 is a schematic diagram illustrating an external appearance of a hydraulic machine according to some embodiments.

FIG. 1 is a schematic diagram illustrating an external appearance of a hydraulic machine according to some embodiments.

A hydraulic machine may carry out work by actuating a working device 300 using hydraulic pressure. In some embodiments, the hydraulic machine may be a construction machine.

In some embodiments, the hydraulic machine may be an excavator as illustrated in FIG. 1. The hydraulic machine may include an upper structure 100, an under structure 200, and the working device 300.

The under structure 200 includes a travel actuator allowing the hydraulic machine to travel. The travel actuator may be a hydraulic motor.

The upper structure 100 may include a pump, a working fluid tank, a power source, a control valve, and the like. In addition, the upper structure 100 may include a swing actuator allowing the upper structure 100 to rotate with respect to the under structure 200. The swing actuator may be a hydraulic motor.

The working device 300 allows the excavator to carry out work. The working device 300 may include a boom 111, an arm 121, and a bucket 131, as well as a boom actuator 113, an arm actuator 123, and a bucket actuator 133 actuating the boom 111, the arm 121, and the bucket 131, respectively. The boom actuator 113, the arm actuator 123, and the bucket actuator 133 may be hydraulic cylinders, respectively.

Figure 2:
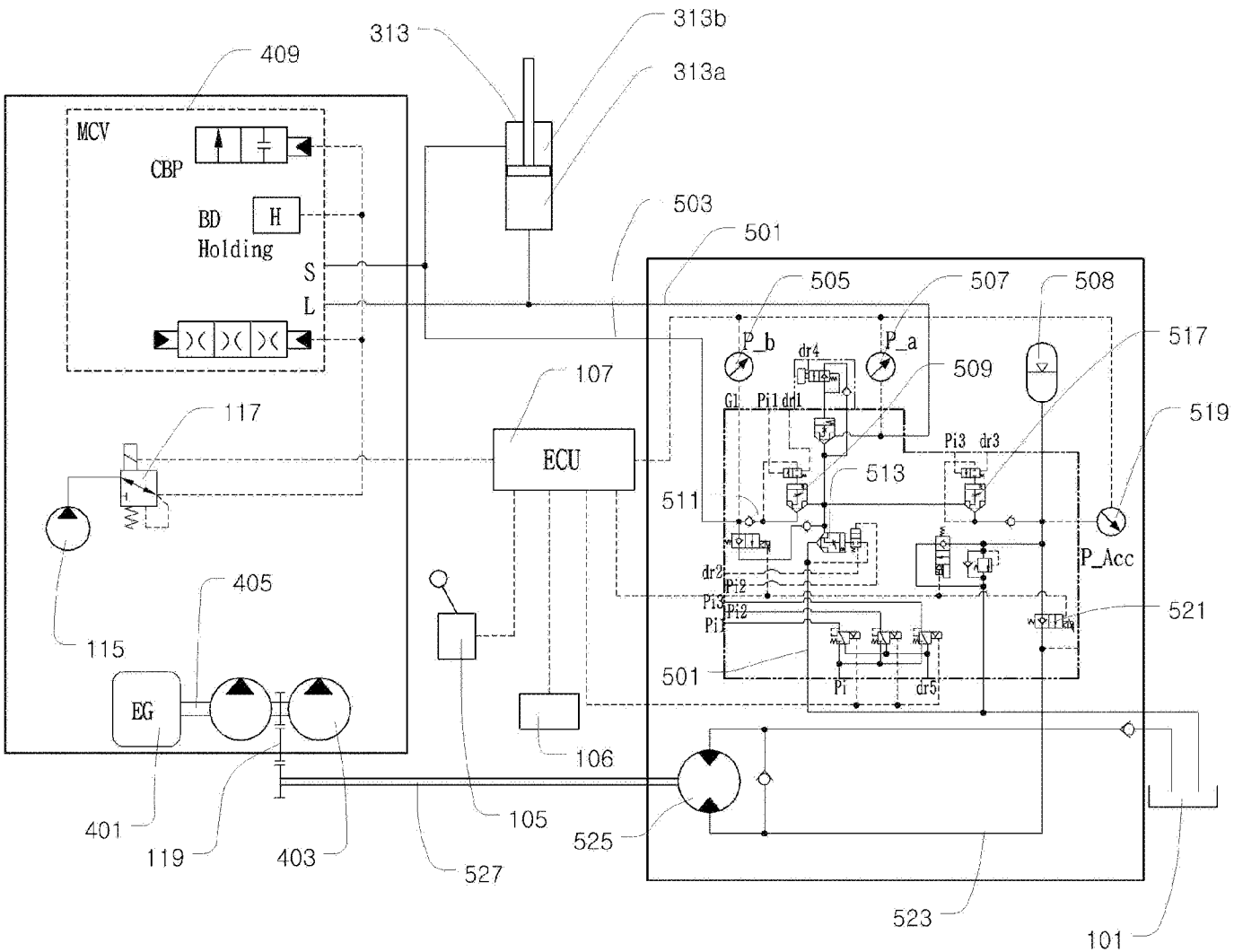
FIG. 2 is a circuit diagram illustrating a hydraulic machine according to some embodiments.
Figure 3:
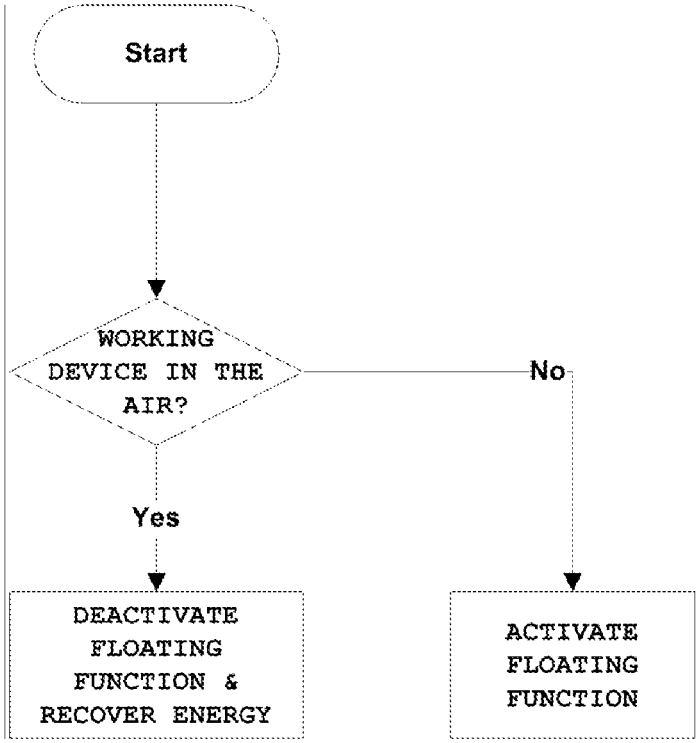
FIG. 3 is a flowchart illustrating a process in which the hydraulic machine illustrated in FIG. 2 performs a floating function or an energy recovery function depending on the position of the working device.

FIG. 2 is a circuit diagram illustrating a hydraulic machine according to some embodiments, and FIG. 3 is a flowchart illustrating a process in which the hydraulic machine illustrated in FIG. 2 performs a floating function or an energy recovery function depending on the position of the working device.

In some embodiments, the hydraulic machine may include the boom actuator 313 including a large chamber 313*a* and a small chamber 313*b*, a floating hydraulic circuit, a tank 101, and a controller 107. In some embodiments, the floating hydraulic circuit may include a first valve 509, a second valve 511, and a third valve 513. In some embodiments, the floating hydraulic circuit may include a first line 501 and a second line 503. In some embodiments, the hydraulic machine may include a recovery unit 525 and a fourth valve 517. In some embodiments, the hydraulic machine may include a recovery line 523. In some embodiments, the hydraulic machine may include an accumulator 508 connected to the recovery line 523.

In some embodiments, the hydraulic machine may include a power source 401, a main pump 403, and a control valve 409. The main pump 403 may direct pressurized fluid toward the boom actuator 313. The power source 401 may drive a pump 403. In some embodiments, the power source 401 may include an engine.

In some embodiments, the power source 401 may drive the main pump 403 by supplying power to the main pump 403 through a main shaft 405. The main pump 403 may pressurize fluid and direct the pressurized fluid toward the boom actuator 313. The boom actuator 313 may receive the pressurized fluid from the main pump 403 and return fluid to the tank 101. The boom actuator 313 may actuate the boom by providing the force of the pressurized fluid received from the main pump 403 to the boom.

In some embodiments, the boom actuator 313 may be a hydraulic cylinder. Since a piston rod connected to the boom extends through the small chamber 313*b*, an effective area on which the pressure inside the small chamber 313*b* acts on the piston is smaller than an effective area on which the pressure inside the large chamber 313*a* acts on the piston, due to the area occupied by the piston rod. Referring to FIG. 1, in a boom down operation in which the boom is lowered, the piston rod is also lowered. Consequently, fluid enters the small chamber 313*b*, whereas fluid is discharged from the large chamber 313*a*.

The control valve 409 may connect the main pump 403, the tank 101, and the boom actuator 313 to control the directions of flows of fluid therebetween. In some embodiments, the control valve 409 may move between a neutral position, a first non-neutral position, and a second non-neutral position. When the control valve 409 is in the neutral position, the control valve 409 may prevent fluid communication with the boom actuator 313 and return the fluid that has flowed from the main pump 403 to the tank 101 through a central bypass path. When the control valve 409 is in the first non-neutral position, the control valve 409 may prevent the fluid that has flowed from the main pump 403 from returning to the tank 101 through the central bypass path, direct the fluid that has flowed from the main pump 403 to the small chamber 313*b*, and direct the fluid that has flowed from the large chamber 313*a* to the tank 101, thereby moving the boom down. When the control valve 409 is in the second non-neutral position, the control valve 409 may prevent the fluid that has flowed from the main pump 403 from returning to the tank 101 through the central bypass path, direct the fluid that has flowed from the main pump 403 to the large chamber 313*a*, and direct the fluid that has flowed from the small chamber 313*b* to the tank 101, thereby moving the boom up.

In some embodiments, the hydraulic machine may include a first operator input device 105 to move the control valve 409. An operator may input his/her request to raise or lower the boom by operating the first operator input device 105. In some embodiments, the first operator input device 105 may be a lever, but the present disclosure is not limited thereto.

In some embodiments, the first operator input device 105 may be an electrical input device, and may generate an electrical signal corresponding to the operator's request and transmit the electrical signal to the controller 107. In some embodiments, the hydraulic machine may include a pilot pump 115 and an electronic proportional pressure reducing valve 117. When receiving an electrical signal from the first operator input device 105, the controller 107 may responsively operate the electronic proportional pressure reducing valve 117 by transmitting a control signal to the electronic proportional pressure reducing valve 117. The electronic proportional pressure reducing valve 117 may operate the control valve 409 by directing pilot fluid that has flowed from the pilot pump 115 to the control valve 409.

In some alternative embodiments, the first operator input device may be a hydraulic input device including a built-in pressure reducing valve (not shown). In addition, the pilot pump 115 may be connected to the pressure reducing valve of the first operator input device, and the pressure reducing valve may transmit a hydraulic signal corresponding to the operator's request to the control valve 409. In some embodiments, the hydraulic machine may include a sensor able to measure the pressure of the hydraulic signal transmitted from pressure reducing valve to the control valve 409. The sensor may generate an electrical signal corresponding to the hydraulic signal and provide the electrical signal to the controller 107. Thus, even though the controller 107 is not directly connected to the first operator input device 105, the controller 107 can determine what request has been input by the operator, i.e., whether a boom down operation request or a boom up operation request has been input by the operator.

The floating hydraulic circuit may be provided between the boom actuator 313 and the tank 101. The floating hydraulic circuit may be connected to the large chamber 313*a*, the small chamber 313*b*, and the tank 101 to perform a floating function allowing the large chamber 313*a*, the small chamber 313*b*, and the tank 101 to communicate with each other.

In some embodiments, the hydraulic machine may include a second operator input device 106 configured to receive a request input by the operator to activate or deactivate the floating hydraulic circuit. In the boom down operation in which the boom is lowered, the controller 107 may determine whether or not the working device is hanging in the air. When the working device is determined to hang in the air, even in the case that a request to activate the floating hydraulic circuit is input to the second operator input device 106, the controller 107 may deactivate the floating hydraulic circuit.

In some embodiments, the hydraulic machine may include a pressure sensor 507 measuring the pressure in the large chamber 313*a* and a pressure sensor 505 measuring the pressure in the small chamber 313*b*. The controller 107 may determine whether or not the working device is hanging in the air, based on the pressure in the large chamber 313*a* and the pressure in the small chamber 313*b*. In some embodiments, when the pressure in the large chamber 313*a*–the pressure in the small chamber 313*b*/(the effective area on which the pressure in the large chamber 313*a* acts/the effective area on which the pressure of the small chamber 313*b* acts) is higher than a predetermined value, the controller 107 may determine that the working device is hanging in the air. In some alternative embodiments, when the pressure in the large chamber 313*a* is higher than a predetermined value, the controller 107 may determine that the working device is hanging in the air.

The first valve 509 may connect the large chamber 313*a* and the small chamber 313*b* to allow or block the flow of fluid from the large chamber 313*a* to the small chamber 313*b*. The second valve 511 may connect the small chamber 313*b* and the large chamber 313*a* to allow or block the flow of fluid from the small chamber 313*b* to the large chamber 313*a*. The third valve 513 may be provided between the large chamber 313*a* and the tank 101 to allow or block the flow of fluid from the large chamber 313*a* to the tank 101. When the floating hydraulic circuit is activated because a request for the floating function to be activated has been input through the second operator input device 106 and the working device is determined to have touched the ground, the first valve 509 allows the flow of fluid from the large chamber 313*a* to the small chamber 313*b*, the second valve 511 allows the flow of fluid from the small chamber 313*b* to the large chamber 313*a*, and the third valve 513 allows the flow of fluid from the large chamber 313*a* to the tank 101, so that the large chamber 313*a*, the small chamber 313*b*, and the tank 101 may communicate with each other.

The first line 501 may connect the large chamber 313*a* and the tank 101, thereby allowing the flow of fluid from the large chamber 313*a* to the tank 101. The second line 503 may be connected to the small chamber 313*b*. The third valve 513 may be provided on the first line 501 to allow or block the flow of fluid from the large chamber 313*a* to the tank 101 through the first line 501. The first valve 509 may be connected to the first line 501 at a location between the large chamber 313*a* and the third valve 513 and to the second line 503, to allow or block the flow of fluid from the first line 501 to the second line 503. The second valve 511 may connect the second line 503 to the first line 501 to each other to allow or block the flow of fluid from the second line 503 to the first line 501.

When the floating hydraulic circuit is activated, the first valve 509 may allow the flow of fluid from the first line 501 to the second line 503, the second valve 511 may allow the flow of fluid from the second line 503 to the first line 501, and the third valve 513 may allow the flow of fluid to the tank 101 through the first line 501.

The fourth valve 511 may be provided between the large chamber 313*a* and the recovery unit 525 to allow or block the flow of fluid from the large chamber 313*a* to the recovery unit 525. The recovery unit 525 is a component recovering power. In some embodiments, the recovery unit 525 may be a hydraulic motor (e.g., an assist motor). The assist motor may assist the power source 401 by supplying the recovered power to the power source 401. In this regard, in some embodiments, the hydraulic machine may include a power transmission. The power transmission may be connected to a pump, the power source 401, and the assist motor to deliver power therebetween. In some embodiments, the power transmission may include the main shaft 405 connecting the power source and the pump, an assist shaft 527 connected to the assist motor, and a power transmission part 119.

In the boom-down operation, when the working device is determined to be hanging in the air, the first valve 509 may be operated to allow the flow of fluid from the large chamber 313*a* to the small chamber 313*b*, the second valve 511 may be operated to block the flow of fluid from the small chamber 313*b* to the large chamber 313*a*, the third valve 513 may be operated to block the flow of fluid from the large chamber 313*a* to the tank 101, and the fourth valve 517 may be operated to allow the flow of fluid from the large chamber 313*a* to the recovery unit 525.

In the boom-down operation, the first valve 509 is opened, and regeneration is performed. At this time, when the third valve 513 is not opened, since the entire amount of the fluid discharged from the large chamber 313*a* of the boom actuator 313 cannot enter the small chamber 313*b*, and the load applied to the working device is added, the entire pressure in the hydraulic circuit is increased. In this manner, the overall pressure in the hydraulic circuit can be increased using this physical phenomenon (i.e., pressure boosting) (for example, by the effective area ratio (e.g., about 1:2) between the large chamber 313*a* and the small chamber 313*b*). When the pressure is increased, the power is also increased according to the formula: power=pressure×flow rate. Consequently, higher power may be obtained with the same flow rate, and thus, the following advantages may be obtained.

For example, in the boom down operation, the pressure is typically controlled to be about 100 bars. The velocity, i.e., the flow rate, of the boom actuator 313 at this time is about 300 Lpm, from which the power may be calculated to be about 50 KW. When the pressure is increased to be about 200 bars, higher power of 100 KW may be obtained with the same flow rate.

Consequently, higher power may be obtained from the accumulator 508 having a limited size, and a higher energy recovery ratio may be obtained in a short operation time of the boom actuator 313. Thus, the amount of the fluid supplied to the assist motor may be reduced, and thereby the size of the motor can be reduced. Accordingly, costs for the accumulator 508 and the motor may be reduced.

The recovery line 523 may connect the large chamber 313*a* and the recovery unit 525. In some embodiments, the recovery line 523 may be connected to the first line 501 in a location between the large chamber 313*a* and the third valve 513, and connected to the recovery unit 525, thereby allowing the flow of fluid from the first line 501 to the recovery unit 525. In some embodiments, the fourth valve 517 may be provided on the recovery line 523. The fourth valve 517 may allow or block the flow of fluid from the first line 501 to the recovery unit 525 through the recovery line 523.

In some embodiments, the hydraulic machine may include a fifth valve 521 provided on the recovery line 523. The fifth valve 521 may allow or block the flow of fluid from the fourth valve 517 to the recovery unit 525. In the boom down operation, the fifth valve 521 may be operated to allow the flow of fluid to the recovery unit 525.

Reference numeral 519 that has not been described hereinbefore indicates a pressure sensor.

The invention claimed is:

1. A hydraulic machine comprising:

a controller;

a tank;

a working device comprising a boom;

a boom cylinder actuating the boom and comprising a large chamber and a small chamber;

a floating hydraulic circuit connected to the large chamber, the small chamber, and the tank to perform a floating function enabling the large chamber, the small chamber, and the tank to communicate with each other; and an operator input device coupled to the controller, the operator input device receiving a request to activate or deactivate the floating hydraulic circuit, input by an operator, wherein, in a boom-down operation in which the boom is lowered, the controller determines whether or not the working device is hanging in the air, and when the working device is determined to be hanging in the air, deactivates the floating hydraulic circuit even when the request to activate the floating hydraulic circuit is input to the operator input device.

2. The hydraulic machine of claim 1, further comprising a pressure sensor measuring a pressure in the large chamber and a pressure in the small chamber, wherein the controller determines whether or not the working device is hanging in the air based on the pressure in the large chamber and the pressure in the small chamber.

3. The hydraulic machine of claim 2, wherein, when the pressure in the large chamber−the pressure in the small chamber/(an effective area on which the pressure in the large chamber acts/an effective area on which pressure of small chamber acts) is higher than a predetermined value, the working device is determined to be hanging in the air.

4. The hydraulic machine of claim 2, wherein, when the pressure in the large chamber is higher than a predetermined value, the working device is determined to be hanging in the air.

5. The hydraulic machine of claim 1, wherein the floating hydraulic circuit comprises:

a first valve connecting the large chamber and the small chamber to allow or block a flow of fluid from the large chamber to the small chamber;

a second valve connecting the small chamber and the large chamber to allow or block a flow of fluid from the small chamber to the large chamber;

a third valve provided between the large chamber and the tank to allow or block a flow of fluid from the large chamber to the tank, wherein, when the floating hydraulic circuit is activated, the first valve allows the flow of fluid from the large chamber to the small chamber, the second valve allows the flow of fluid from the small chamber to the large chamber, and the third valve allows the flow of fluid from the large chamber to the tank, thereby allowing the large chamber, the small chamber, and the tank to communicate with each other.

6. The hydraulic machine of claim 5, wherein the floating hydraulic circuit comprises:

a first line connecting the large chamber and the tank; and a second line connected to the small chamber, wherein the third valve is provided on the first line, the first valve is connected to the first line at a location between the large chamber and the third valve, and connected to the second line to allow or block a flow of fluid from the first line to the second line, the second valve connects the second line and the first line to allow or block a flow of fluid from the second line to the first line, and when the floating hydraulic circuit is activated, the first valve allows the flow of fluid from the first line to the second line, the second valve allows the flow of fluid from the second line to the first line, and the third valve allows a flow of fluid to the tank through the first line.

7. The hydraulic machine of claim 5, wherein the hydraulic machine further comprises:

a recovery unit recovering power; and a fourth valve provided between the large chamber and the recovery unit to allow or block a flow of fluid from the large chamber to the recovery unit, wherein, in the boom down operation, when the working device is determined to be hanging in the air, the first valve is operated to allow the flow of fluid from the large chamber to the small chamber, the second valve is operated to block the flow of fluid from the small chamber to the large chamber, the third valve is operated to block the flow of fluid from the large chamber to the tank, and the fourth valve is operated to allow the flow of fluid from the large chamber to the recovery unit.

8. The hydraulic machine of claim 7, wherein the floating hydraulic circuit further comprises:

a first line provided between the large chamber and the tank; and a second line connected to the small chamber, wherein the third valve is provided on the first line, the first valve is connected to the first line in a location between the large chamber and the third valve, and connected to the second line to allow or block a flow of fluid from the first line to the second line, the second valve is connected to the second line and connected to the first line at a location between the large chamber and the third valve, to allow or block a flow of fluid from the second line to the first line, the hydraulic machine further comprising:

a recovery line connected to the first line in a location between the large chamber and the third valve, and connected to the recovery unit; and a fourth valve configured to allow or block a flow of fluid through the recovery line, wherein, in the boom down operation, when the working device is determined to be hanging in the air, the first valve is operated to allow the flow of fluid from the first line to the second line, the second valve is operated to block the flow of fluid from the second line to the first line, the third valve is operated to block a flow of fluid to the tank through the first line, and the fourth valve is operated to allow a flow of fluid from the first line to the recovery unit through the recovery line.

* * * * *